US005711016A

United States Patent [19]

Carpena et al.

[11] Patent Number: 5,711,016

[45] Date of Patent: Jan. 20, 1998

[54] PROCESS FOR THE CONDITIONING OF RADIOACTIVE IODINE, PARTICULARLY IODINE 129, USING AN APATITE AS THE CONFINEMENT MATRIX

[75] Inventors: Joëlle Carpena, Jouques; Fabienne Audubert, Manosque; Jean-Louis Lacout, Toulouse, all of France

[73] Assignee: Commissariat a l'Energie Atomique, Paris, France

[21] Appl. No.: 682,792

[22] PCT Filed: Nov. 6, 1995

[86] PCT No.: PCT/FR95/01454

§ 371 Date: Oct. 24, 1996

§ 102(e) Date: Oct. 24, 1996

[87] PCT Pub. No.: WO96/18126

PCT Pub. Date: Jul. 13, 1996

[30] Foreign Application Priority Data

Dec. 7, 1994 [FR] France ..... 94 14706

[51] Int. Cl.[6] ..... G21F 9/00

[52] U.S. Cl. ..... 588/10; 588/16; 588/252; 588/15; 588/14; 252/625; 264/60; 423/240 R

[58] Field of Search ..... 588/10, 14, 15, 588/16, 252; 252/625; 264/60; 423/240 R; 976/DIG. 385

[56] References Cited

U.S. PATENT DOCUMENTS

| | | | |
|---|---|---|---|
| 4,088,737 | 5/1978 | Thomas et al. | 423/240 |
| 4,229,317 | 10/1980 | Babad et al. | 562/54 |
| 4,274,976 | 6/1981 | Ringwood | 588/15 |
| 5,075,084 | 12/1991 | Jurgen et al. | 423/241 |
| 5,193,936 | 3/1993 | Pal et al. | 405/128 |
| 5,512,702 | 4/1996 | Ryan et al. | 588/256 |

FOREIGN PATENT DOCUMENTS

| | | | |
|---|---|---|---|
| 379895 | 8/1990 | European Pat. Off. . | |
| 7504015 | 1/1976 | Netherlands . | |
| 1 513 964 | 6/1978 | United Kingdom | B01D 53/02 |
| WO95/02886 | 1/1995 | WIPO . | |

OTHER PUBLICATIONS

Chemical Abstracts, vol. 108, No. 6, 8 Feb. 1988, Columbus, Ohio, US: Abstract No. 48173, Miyake "Fixation of Iodine Ions in Lead(2+)–Silver(1+) Exchanged Hydroxyapatites", p. 709.

*Primary Examiner*—Ngoclan Mai

*Attorney, Agent, or Firm*—Pearne, Gordon, McCoy & Granger LLP

[57] ABSTRACT

The invention relates to the conditioning or packaging of radioactive iodine, particularly iodine 129, using an apatite as the confinement matrix. Having the iodine, said apatite corresponds to the formula:

$$M_{10}(XO_4)_{6-6x}(PO_4)_{6x}I_2 \quad (I)$$

in which M represents Cd or Pb, X represents V or As, I is the radioactive iodine to be conditioned and x is such that $0 \leqq x < 1$. This iodoapatite (1) can be surrounded by an apatite (3) not containing iodine serving as a physical barrier.

The iodoapatite can be obtained from a solid compound of the iodine, e.g. an iodide such as silver iodide or lead iodide, by reaction with a compound of formula:

$$M_3(XO_4)_{2-2x}(PO_4)_{2x} \quad (II)$$

or $$M_{10}(XO_4)_{6-6x}(PO_4)_{6x}Y_2 \quad (III)$$

in which M, X and x are as defined hereinbefore and Y can represent OH, F, Cl or $O_{1/2}$.

25 Claims, 1 Drawing Sheet

PROCESS FOR THE CONDITIONING OF RADIOACTIVE IODINE, PARTICULARLY IODINE 129, USING AN APATITE AS THE CONFINEMENT MATRIX

The present invention relates to the conditioning or packaging of radioactive iodine, particularly iodine 129, which is a β and γ emitting fission product having a decay period of $1.6.10^7$ years.

Radioactive iodine is present in irradiated fuels from nuclear reactors. This iodine is released when said fuels are reprocessed. Thus, gaseous iodine occurs in the gases emitted by the irradiated fuel dissolving solution and iodine traces appear in aqueous effluents. As iodine 129 is toxic for humans due to its strong affinity for the thyroid gland, it is necessary to eliminate said iodine and store it on a definitive basis for a long time due to its very high period, although the specific radioactivity of iodine 129 is very low, because a high iodine 129 concentration would be dangerous to health. It is therefore vital to condition and store iodine 129 in a reliable matrix.

Existing methods for the trapping of iodine 129 lead to the obtaining of silver iodide, copper iodide, lead iodide or barium iodate. For storing the thus trapped iodine, several procedures have been studied and consideration has been given to the storage thereof in ceramic phases or in low melting point glasses, but a stable phase is still being sought for long term storage purposes.

The present invention relates to a block for the conditioning of radioactive iodine, particularly iodine 129, which uses as the confinement matrix a material having properties particularly appropriate for long term storage.

According to the invention, the radioactive iodine conditioning block comprises an iodoapatite of formula:

$$M_{10}(XO_4)_{6-6x}(PO_4)_{6x}I_2 \quad (I)$$

in which M represents Cd or Pb, X represents V or As, I is the radioactive iodine to be conditioned and x is such that $0 \leqq x < 1$.

In this block, the iodine is chemically trapped in an apatite structure, which has very advantageous properties for a long term conditioning.

Thus, apatites have the very interesting property of being able to integrate into their structure other elements and in particular different halogens such as iodine. Moreover, apatites have the following remarkable properties:

- their structure is highly chemically and thermally stable,
- apatites have a very limited solubility in water and their solubility decreases when the temperature increases,
- apatite structures are able to withstand β and γ radioactivity and
- apatites can receive in their lattice molecular species such as oxygen, so that they are able to receive the non-radioactive xenon produced by the radioactive disintegration of iodine 129 without embrittlement or increasing the porosity of the conditioning matrix.

Natural fluoapatite complies with the following formula:

$$Ca_{10}(PO_4)_6F_2$$

In this structure, numerous substitutions can be made and in particular the calcium can be replaced by various divalent cations such as cadmium, strontium, barium, lead, etc., the phosphate ions can be substituted by vanadate or arsenate ions and the $F^-$ anions can be substituted by monovalent anions such as $I^-$. Due to the size of the $I^-$ anion, it is only possible to replace $F^-$ by $I^-$ in apatites complying with general formula I in which M is Cd or Pb, X is V or As and $0 \leqq x < 1$.

Thus, in the block according to the invention, the replacement of the phosphate groups of natural apatite by more voluminous $VO_4$ or $AsO_4$ groups leads to a significant increase in the lattice constants. This leads to an increase in the section of the tunnels of the apatite, because said section is directly linked with the value of the lattice constant a and this makes it possible to introduce into the tunnels an iodide ion, whose ion radius (2.20 Å) is much larger than that of the $F^-$ or $Cl^-$ ions (1.33 and 1.81 Å respectively) present in the natural apatite.

In the same way, the substitution of the $Ca^{2+}$ cation of the natural apatite by a more voluminous cation such as Pb, leads to an increase in the lattice constants and facilitates the introduction of $I^-$ into the tunnels.

In the case of $Cd^{2+}$, which has an ion radius (0.95 Å) smaller than that of $Ca^{2+}$ (1.00 Å), the possibility exists to introduce $I^-$ in place of $F^-$ or $Cl^-$, which may be explainable by the strong polarizability of the $Cd^{2+}$ ion and also the presence of $XO_4^{3-}$ ions, which are more voluminous than $PO_4^{3-}$.

As will be shown hereinafter, the block according to the invention can be prepared by reacting an iodine-containing compound with a solid compound of formula:

$$M_3(XO_4)_{2-2x}(PO_4)_{2x} \quad (II)$$

in which M, X and x have the meanings given hereinbefore.

According to the invention, it may be advantageous not to totally replace the $PO_4^{3-}$ ions of the natural apatite by $VO_4^{3-}$ or $AsO_4^{3-}$ ions, because it is preferable that the solid compound (II), in the case where M=Pb, X=V and x=0, is in the γ phase in the useful temperature range for the production of the block, namely 20° to 800° C.

However, it is known that in cases where x=0, M is Pb and X represents V, the solid compound, lead orthovanadate, undergoes a β-γ phase transition at 120° C., which induces a 1.4% volume contraction prejudicial to the long term good behaviour of the material, i.e. the conditioning block of the invention.

However, when the $VO_4^{3-}$ ions are partly replaced by $PO_4^{3-}$ ions (x>0) the phase transition temperature is lowered, it e.g. appearing at −50° C. when x=0.2. Thus, for x=0.2, the material undergoes no phase transition the temperature range used for producing the block according to the invention. It is consequently of interest to retain part of the $PO_4^{3-}$ ions in order to prevent an embrittlement of the block during its production.

Preferably, x is such that $0.1 \leqq O \leqq 0.75$ and good results are obtained for x between 0.1 and 0.3.

According to the invention, it is possible to further improve the performance characteristics of the conditioning by surrounding the iodoapatite containing in its structure the radioactive iodine to be conditioned, by one or more layers of apatites not containing iodine having various compositions and serving as a physical barrier resisting external attacks and stresses.

The composition of the different layers can be modified in such a way that the internal layer or layers ensure the trapping of the iodine, whereas the external layer or layers resist attacks from the external medium.

The apatites not containing iodine used are chosen as a function of their properties, so that the conditioning has both a good resistance to dissolving in water and a good resistance to irradiation damage. As an example of a usable apatite, reference is made to phosphocalcium fluoapatites and phosphosilicate fluoapatites (britholites).

In order to chemically trap iodine in an apatite structure in iodoapatite form, it is possible to start with an iodine-containing compound in the solid state, such as a metal iodide, and react it with a compound of formula:

$$M_3(XO_4)_{2-2x}(PO_4)_{2x} \quad \text{(II)}$$

in which M, X and x have the meanings given hereinbefore, also in the solid state, at a temperature between 500° and 800° C.

This solid/solid reaction corresponds to the following diagrams, in the cases where the starting iodine-containing compound is $PbI_2$ or AgI:

$$PbI_2+3[M_3(XO_4)_{2-2x}(PO_4)_{2x}]\rightarrow PbM_9(XO_4)_{6-6x}(PO_4)_{6x}I_2$$

$$AgI+3[M_3(XO_4)_{2-2x}(PO_4)_{2x}]\rightarrow AgM_9(XO_4)_{6-6x}(PO_4)_{6x}I\ \square$$

the symbol □ representing a lacuna in the iodine site.

This reaction can take place on the basis of fine powders of iodide and the compound of formula (II), by subjecting them to sintering at 500° to 800° C. The sintering time is chosen as a function of the temperature used and can range between 1 and 3 hours. This reaction is preferably performed on a mixture of powders compressed under an isostatic or uniaxial pressure of e.g. 50 to 200 MPa (5 to 20 kbar). The mixture can be compressed in moulds having the shape of blocks or pellets.

The use of pressure during sintering permits a more intimate contact between the powders and a better confinement of the iodine during the consolidation of the mixture in the form of blocks or pellets, which consequently have good mechanical properties with a view to a long term storage.

The compounds of formula $M_3(XO_4)_{2-2x}(PO_4)_{2x}$ can be prepared by conventional processes.

In the case where M represents Pb and x=0, it is possible to obtain these compounds by the solid/solid reaction of a mixture of lead oxide or vanadium pentoxide or lead oxide and $NH_4H_2AsO_4$ or $As_2O_5.nH_2O$, at a temperature of approximately 700° C.

In the case where M represents Cd, a process of a similar nature can be used and the lead oxide is replaced by cadmium oxide.

According to a variant of the invention, when the radioactive iodine is in the gaseous state or in the form of a sublimatable, iodine-containing compound, it is possible to obtain the iodoapatite trapping the radioactive iodine of formula (I) from an apatite of formula:

$$M_{10}(XO_4)_{6-6x}(PO_4)_{6x}Y_2 \quad \text{(III)}$$

in which M, X and x have the meanings given hereinbefore and Y represents F, Cl, OH or $O_{1/2}$, by contacting said apatite with a gas containing gaseous iodine or the sublimatable compound vapour, in order to exchange Y by radioactive iodine and fix the iodine in iodine-containing apatite form.

The starting apatite of formula (III) can be prepared by conventional processes, e.g. by the double decomposition of lead nitrate and vanadium pentoxide, in an aqueous medium, in the case where M represents lead, X represents V, Y represents OH and x=0.

According to the invention, the radioactive iodine conditioning block can be produced so as to incorporate, as from the start of the long term storage, the radioactive iodine in the form of the iodoapatite of formula (I). However, it is also possible to produce it from different constituents, whereof one contains the radioactive iodine in the form of a solid iodine-containing compound, by carefully distributing the constituents within the block in order to form, during the long term storage, the iodoapatite of formula (I).

In the latter case, according to a first embodiment, the block for conditioning the radioactive iodine in the form of a solid, iodine-containing compound, comprises a core formed from said iodine-containing compound, surrounded by a first compacted powder layer of a compound complying with one of the formulas:

$$M_3(XO_4)_{2-2x}(PO_4)_{2x} \quad \text{(II)}$$

or $$M_{10}(XO_4)_{6-6x}(PO_4)_{6x}Y_2 \quad \text{(III)}$$

in which M represents Cd or Pb, X represents V or As, Y represents OH, F, Cl or $O_{1/2}$ and x is such that $0 \leqq x < 1$ and a second outer layer of apatite not containing iodine.

According to a second embodiment, the block for conditioning the radioactive iodine in the form of a solid, iodine-containing compound comprises granules of said iodine-containing compound coated with a layer of a compound complying with one of the formulas:

$$M_3(XO_4)_{2-2x}(PO_4)_{2x} \quad \text{(II)}$$

or $$M_{10}(XO_4)_{6-6x}(PO_4)_{6x}Y_2 \quad \text{(III)}$$

in which M represents Cd or Pb, X represents V or As, Y represents OH, F, Cl or $O_{1/2}$ and x is such that $0 \leqq x < 1$, the coated granules being dispersed in a matrix of apatite not containing iodine.

Generally, the iodine-containing compound in the solid state is a metal iodide such as AgI or $PbI_2$, in the first embodiment.

The iodine-containing compounds used as the starting product for producing the blocks according to the invention correspond to the compounds obtained during the elimination of iodine from aqueous effluents and gaseous effluents of reprocessing plants, or are directly prepared therefrom.

BRIEF DESCRIPTION OF THE DRAWINGS

Other features and advantages of the invention can be gathered from the following description relative to non-limitative, exemplified embodiments and with respect to the attached drawings, wherein show:

FIG. 1 shows a radioactive iodine conditioning block according to the invention comprising a core 1 formed from iodoapatite complying with formula (I), surrounded by a layer 3 of apatite not containing iodine and serving as a protective barrier against external attacks and stresses.

Figure 1:
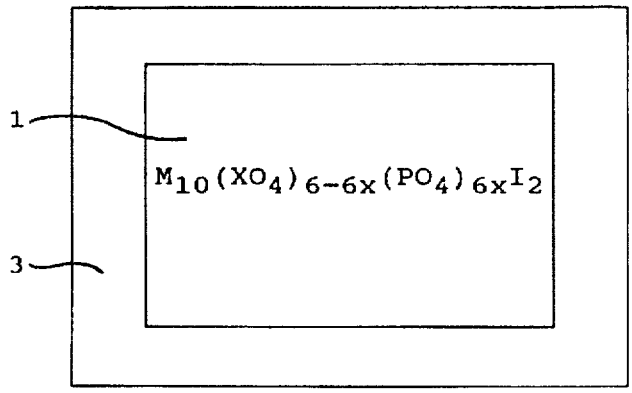
FIG. 1 Diagrammatically a conditioning block according to the invention.

The following procedure is used for producing such a block, in which the iodoapatite complies with the formula $Pb_{10}(VO_4)_6I_2$.

Firstly lead orthovanadate of formula $Pb_3(VO_4)_2$ is prepared by mixing in stoichiometric proportions a lead oxide powder and a vanadium oxide powder, both having an average grain size of 20 μm, and by making said mixture undergo at least two cycles, each involving a heat treatment at 700° C. and grinding at ambient temperature spread over a period of approximately 6 hours.

Mixing then takes place in stoichiometric proportions of the previously obtained lead orthovanadate powder (average grain size 1 μm) and a lead iodide powder (average grain 10 μm) containing the radioactive iodine to be conditioned. The mixture is then treated at 700° C. for 1 h in a stainless steel reactor in order to form the iodoapatite of the core 1. The latter is obtained by compression, during or after iodoapatite synthesis, under a pressure of at least 1 MPa. The thus obtained part is then placed in a storage container and is surrounded by a protective barrier 3 filling the space between the part and the container. This barrier 3 is constituted by synthetic apatites (fluoapatite or britholites) or natural apatites.

Figure 2:
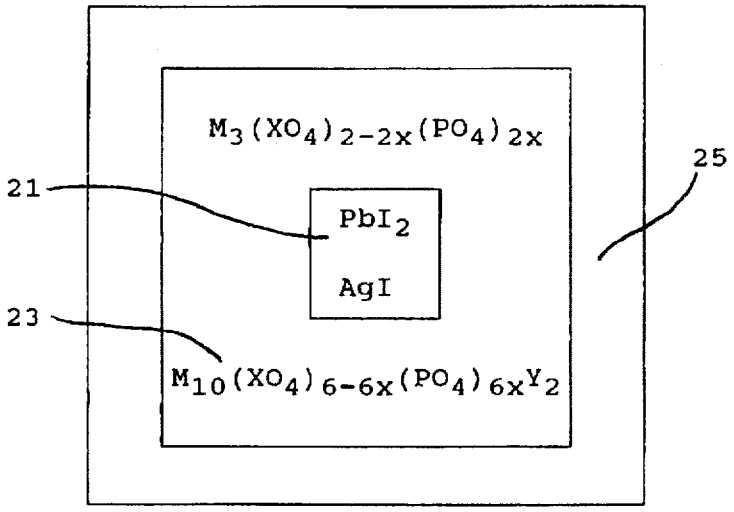
FIG. 2 A first embodiment of a conditioning block according to the invention, in which the iodoapatite fixing the radioactive iodine forms during the long term storage.

FIG. 2 shows a first embodiment of a conditioning block according to the invention, in which the iodoapatite forms during long term storage. In this case, the radioactive iodine to be conditioned is in the form of a solid, iodine-containing compound, e.g. lead iodide or silver iodide. This compound forms the core 21 of the block and is surrounded by a first layer 23 of a compound of formula $M_3(XO_4)_{2-2x}(PO_4)_{2x}$ or formula $M_{10}(XO_4)_{6-6x}(PO_4)_{6x}Y_2$, in which M, X, Y and x have the meanings given hereinbefore, and a second layer 25 of apatite not containing iodine constituting a protective apatite matrix. The assembly constituted by the core 21 and the layer 23 undergoes sintering under pressure of e.g. 20 to 200 MPa in a furnace, at a temperature of 500° to 800° C. and for 1 to 3 h.

The conditioning block can be obtained by compressing ($P \geqq 1$ MPa) the fritted assembly (21, 23) and the second layer (25) of apatite not containing iodine and by subjecting everything to sintering under a pressure of e.g. 20 to 200 MPa, in a furnace, at a temperature of 500° to 800° C. and for 1 to 3 h.

Figure 3:
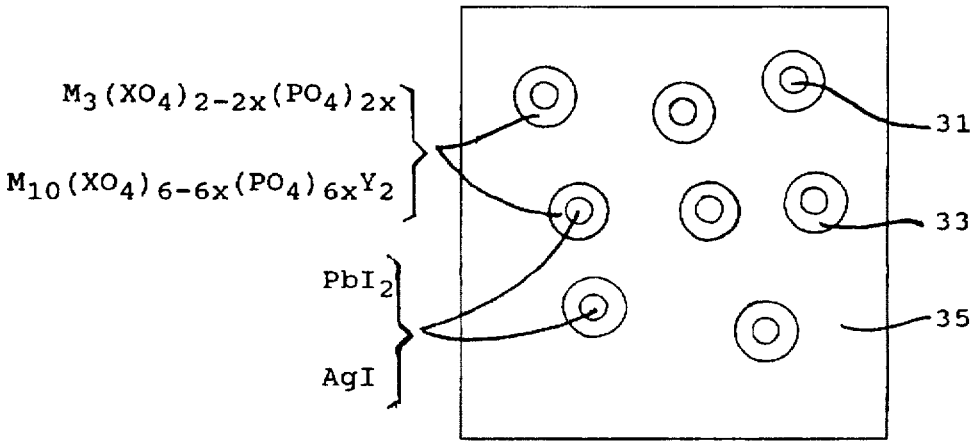
FIG. 3 A second embodiment of a conditioning block according to the invention, where once again the iodoapatite forms during the long term storage.

FIG. 3 shows another embodiment of a conditioning block according to the invention, in which the iodoapatite forms during the long term storage. In this case, granules 31 of a solid, iodine-containing compound containing the radioactive iodine to be conditioned are coated with a layer 33 of a compound complying with one of the formulas $M_3(XO_4)_{2-2x}(PO_4)_{2x}$ and $M_{10}(XO_4)_{6-6x}(PO_4)_{6x}Y_2$ in which M, X, Y and x have the meanings given hereinbefore, and are dispersed in a matrix of apatite not containing iodine forming a physical barrier.

This block can be prepared in the following way. Firstly the granules of the solid, iodine-containing compound, e.g. silver iodide or lead iodide are prepared by a conventional method. These granules 31 are then covered with a layer 33 of $M_3(XO_4)_{2-2x}(PO_4)_{2x}$ or $M_{10}(XO_4)_{6-6x}(PO_4)_{6x}$, and the assembly undergoes sintering under pressure, optionally under isostatic pressure, under conditions identical to those described in conjunction with 21, 23 of FIG. 2. They are then dispersed in a non-iodide-containing apatite powder forming the matrix 35 and everything is subject to a pressurized sintering at 20 to 200 MPa under conditions identical to those described for the block of FIG. 2.

According to a variant of the block according to the invention, applicable in the case of the blocks of FIGS. 2 and 3, the assembly formed by the iodine-containing compound surrounded by the first layer of $M_3(XO_4)_{2-2x}(PO_4)_{2x}$ or $M_{10}(XO_4)_{6-6x}(PO_4)_{6x}Y_2$ and the outer layer of non-iodine-containing apatite undergoes compression under a pressure of at least 1 MPa and then everything undergoes pressurized sintering under the same conditions, e.g. pressure 20 to 200 MPa, temperature 500° to 800° C. and duration 1 to 3 h, as hereinbefore.

A description will now be given of the production of a conditioning block by the synthesis of a weakly $PO_4$ substituted iodoapatite of formula:

$$Pb_{10}(VO_4)_{4.8}(PO_4)_{1.2}I_2 \ (x=0.2)$$

This synthesis corresponds to the reaction:

$$3Pb_3(VO_4)_{1.6}(PO_4)_{0.4}+PbI_2 \rightarrow Pb_{10}(VO_4)_{4.8}(PO_4)_{1.2}I_2$$

Preparation takes place of a composite ceramic constituted by a $PbI_2$ core and an enveloping or covering layer of $Pb_3(VO_4)_{1.6}(PO_4)_{0.4}$ by sintering at 700° C. under 25 MPa.

This composite ceramic is then covered with a layer of fluoapatite $Ca_{10}(PO_4)_6F_2$ and sintering takes place at 700° C., under 25 MPa, to obtain a block having an identical structure to that of the block of FIG. 2. In this case reference 21 represents $PbI_2$, reference 23 represents $Pb_3(VO_4)_{1.6}(PO_4)_{0.4}$ and reference 25 represents $Ca_{10}(PO_4)_6F_2$.

The blocks obtained according to the invention makes it possible to guarantee an effective, reliable storage of radioactive iodine, such as $^{129}I$, for very long periods.

We claim:

1. Block for conditioning radioactive iodine, characterized in that it comprises an iodoapatite of formula:

$$M_{10}(XO_4)_{6-6x}(PO_4)_{6x}I_2 \quad (I)$$

in which M represents Cd or Pb, X represents V or As, I is the radioactive iodine to be conditioned and x is such that $0 \leqq x < 1$.

2. Block according to claim 1, characterized in that the iodoapatite containing the radioactive iodine to be conditioned is surrounded by one or more layers of apatite not containing iodine.

3. Block for conditioning radioactive iodine in the form of a solid, iodine-containing compound, characterized in that it comprises a core formed by said iodine-containing compound, surrounded by a first compacted powder layer of a compound complying with one of the formulas:

$$M_3(XO_4)_{2-2x}(PO_4)_{2x} \quad (II)$$

or $$M_{10}(XO_4)_{6-6x}(PO_4)_{6x}Y_2 \quad (III)$$

in which M represents Cd or Pb, X represents V or As, Y represents OH, F, Cl or $O_{1/2}$ and x is such that $0 \leqq x < 1$, and a second outer layer of non-iodine-containing apatite.

4. Block for conditioning radioactive iodine in the form of a solid, iodine-containing compound, characterized in that it comprises granules of said iodine-containing compound covered with a layer of a compound complying with one of the formulas:

$$M_3(XO_4)_{2-2x}(PO_4)_{2x} \quad (II)$$

or $$M_{10}(XO_4)_{6-6x}(PO_4)_{6x}Y_2 \quad (III)$$

in which M represents Cd or Pb, X represents V or As, Y represents OH, F, Cl or $O_{1/2}$ and x is such that $0 \leqq x < 1$, the coated granules being dispersed in a matrix of apatite not containing iodine.

5. Block according to claim 3, characterized in that the compound of formula $(M_3(XO_4)_{2-2x}(PO_4)_{2x}$ is $Pb_3(VO_4)_2$.

6. Block according to claim 1, characterized in that x is such that $0.1 \leqq x \leqq 0.75$.

7. Block according to claim 2, characterized in that the apatite not containing iodine is chosen from among phosphocalcium fluoapatites and phosphosilicate fluoapatites.

8. Block according to claim 3, characterized in that the iodine-containing compound is AgI or $PbI_2$.

9. Block according to claim 1, characterized in that the radioactive iodine is iodine 129.

10. Process for the conditioning of the radioactive iodine present in the form of a solid, iodine-containing compound, characterized in that it consists of reacting the iodine-containing compound with a solid compound of formula:

$$M_3(XO_4)_{2-2x}(PO_4)_{2x} \quad (II)$$

in which M represents Cd or Pb, X represents V or As and x is such that $0 \leqq x < 1$, also in the solid state, at a temperature of 500° to 800° C.

11. Process according to claim 10, characterized in that the iodine-containing compound is AgI or $PbI_2$.

12. Process for the production of a radioactive iodine conditioning block according to claim 3, characterized in that it consists of subjecting to a pressurized sintering the core of the block and the layer of the compound of formula $M_3(XO_4)_{2-2x}(PO_4)_{2x}$ or $M_{10}(XO_4)_{6-6x}(PO_4)_{6x}Y_2$, surrounding everything with the non-iodine-containing apatite powder forming the outer layer and subjecting the sintered assembly and the outer layer to a pressurized sintering.

13. Process for the production of a radioactive iodine conditioning block according to claim 3, characterized in that it consists of subjecting to a compression under a pressure of at least 1 MPa the assembly formed by the iodine-containing compound, surrounded by the first layer of compound of formula (II) or (III) and the outer layer of non-iodine-containing apatite and then subjecting everything to pressurized sintering.

14. Process according to claim 12, characterized in that sintering is performed at a temperature of 500° to 800° C., under a pressure of 20 to 200 MPa and for 1 to 3 h.

15. Block according to claim 4, characterized in that the compound of formula $M_3(XO_4)_{2-2x}(PO_4)_{2x}$ is $Pb_3(VO_4)_2$.

16. Block according to claim 3, characterized in that x is such that $0.1 \leqq x \leqq 0.75$.

17. Block according to claim 4, characterized in that x is such that $0.1 \leqq x \leqq 0.75$.

18. Block according to claim 3, characterized in that the non-iodine-containing apatite is chosen from among phosphocalcium fluoapatites and phosphosilicate fluoapatites.

19. Block according to claim 4, characterized in that the non-iodine-containing apatite is chosen from among phosphocalcium fluoapatites and phosphosilicate fluoapatites.

20. Block according to claim 4, characterized in that the iodine-containing compound is AgI or $PbI_2$.

21. Block according to claim 3, characterized in that the radioactive iodine is iodine 129.

22. Block according to claim 4, characterized in that the radioactive iodine is iodine 129.

23. Process for the production of a radioactive iodine conditioning block according to claim 4, characterized in that it consists of subjecting a pressurized sintering the granules iodine-containing compound and the layer of the compound of formula $M_3(XO_4)_{2-2x}(PO_4)_{2x}$ or $M_{10}(XO_4)_{6-6x}(PO_4)_{6x}Y_2$, surrounding everything with the non-iodine-containing apatite powder forming the outer layer and subjecting the sintered assembly and the outer layer to pressurized sintering.

24. Process for the production of a radioactive iodine conditioning block according to claim 4, characterized in that it consists of subjecting to compression under a pressure of at least 1 MPa the assembly formed by the granules of iodine-containing compound surrounded by the first layer of compound of formula (II) or (III) and the outer, non-iodine-containing apatite layer, then subjecting everything to pressurized sintering.

25. Process according to claim 23, characterized in that sintering is performed at a temperature of 500° to 800° C. under a pressure of 20 to 200 MPa and for 1 to 3 h.

* * * * *